United States Patent [19]

Hickey et al.

[11] 4,243,349

[45] Jan. 6, 1981

[54] CONTAINERS FOR GOODS

[76] Inventors: Christopher D. D. Hickey, 5 Heathside, Hinchley Wood, Esher, Surrey; Harold J. Clements, 20 St. Michaels Close, Harbledown, Canterbury, CT2 9BN, Kent, both of England

[21] Appl. No.: 20,015

[22] Filed: Mar. 13, 1979

Related U.S. Application Data

[63] Continuation-in-part of Ser. No. 806,101.

[30] Foreign Application Priority Data

Jun. 14, 1976 [GB] United Kingdom ..... 24575/76

[51] Int. Cl.[3] ..... B64D 9/00

[52] U.S. Cl. ..... 410/77; 244/118.1; 410/97; 410/119; 410/128; 417/29; 200/83 C; 200/83 W; 150/0.5

[58] Field of Search ..... 244/118.1; 410/77, 84, 410/85, 119, 117, 97, 128; 200/83 C, 83 W, 83 SA; 417/28, 38, 29; 150/0.5, 52; 92/40

[56] References Cited

U.S. PATENT DOCUMENTS

| | | | |
|---|---|---|---|
| 2,472,623 | 6/1949 | Schulze | 244/118.1 |
| 2,653,629 | 9/1953 | Hoffinvoth | 200/83 SA |
| 2,697,764 | 12/1954 | Burlingham | 200/83 C |
| 2,764,950 | 10/1956 | Finnell | 410/119 |
| 2,847,032 | 8/1958 | Fleming | 92/40 |
| 2,960,942 | 11/1960 | Pier et al. | 410/119 |
| 3,000,418 | 9/1961 | Bitting | 150/52 |
| 3,098,455 | 7/1963 | McElroy et al. | 417/29 |
| 3,850,214 | 11/1974 | Hickey | 150/0.5 |
| 3,957,395 | 5/1976 | Ensign | 417/28 |

FOREIGN PATENT DOCUMENTS 1191921 5/1970 United Kingdom .

*Primary Examiner*—Galen L. Barefoot
*Attorney, Agent, or Firm*—Young & Thompson

[57] ABSTRACT

In a container of the kind having a rigid impermeable base and a flexible impermeable cover which is sealed to the base, and in which air is evacuated from the region between the cover and the base so that the cover is drawn down onto goods on the base, there is provided a bellows-type vacuum sensor which senses the air pressure in the container and which operates switch contacts controlling a pump. When the container is used in an aircraft, where the ambient pressure inside the aircraft falls considerably when the aircraft is at high altitudes, the pump is actuated to ensure that the pressure in the container is maintained below the ambient pressure in the aircraft. An excess pressure difference, which might overload shock absorbing mounts for goods on the container base, is prevented by the bellows opening relief air ports.

6 Claims, 5 Drawing Figures

CONTAINERS FOR GOODS

REFERENCE TO RELATED APPLICATION

This application is a continuation-in-part of Application Ser. No. 806,101 filed on June 13, 1977 now abandoned.

BACKGROUND OF THE INVENTION

1. Field of the Invention

This invention relates to containers for goods of the kind having a rigid impermeable base and a flexible impermeable cover which is put over goods on said base and which is sealed to said base.

2. Description of the Prior Art

With this type of container, by evacuating air from the region between the cover and the base, the cover is held down by air pressure onto any goods on the base, as is described, for example, in British Pat. No. 1,191,921 and U.S. Pat. Nos. 3,000,418 and 2,472,623. The cover thereby serves not only as a protective cover but also to secure goods in position on the base. Such an arrangement therefore provides a convenient means not only for storing goods in conditions where they are protected from the ambient atmosphere but also for transport purposes. The base is conveniently made in the form of a pallet to facilitate handling. The cover may be sealed to the base for example in the manner described in U.S. Pat. No. 3,850,214 by providing an endless tube around the periphery of the cover sheet, which tube is put in a slot or groove in said base and inflated so as to be securely held in the slot or groove.

The vacuum required within the cover for storage purposes and to ensure that the cover is held down firmly need only be quite small. The amount of vacuum, that is the amount of pressure difference below atmospheric pressure, may, for example, be of the order of 0.1 to 2.0 lb/square inch and typically would be less than 0.5 lb/square inch. For use for storage purposes, it is satisfactory to provide such containers with a one-way valve permitting connection of the interior of the container to a vacuum pump or other vacuum source. Simple pumping equipment readily permits of evacuation of sufficient air to achieve the required pressure difference. If necessary, the container may be initially filled with dry air or an inert gas to provide a suitable atmosphere for storage purposes.

When such a container is carried by aircraft however, the ambient pressure in the aircraft, when flying at altitude, is typically at a level substantially below the pressure inside the container. As a result therefore the cover, instead of being firmly held down on the goods on the base of the container, is expanded by the higher pressure within the container than in the surrounding atmosphere in the aircraft. It is known to provide the base of the container with posts to enable containers to be stacked and it is convenient for many purposes to provide panels, for example wire mesh panels around the sides and over the top of the container to prevent unauthorised access to the goods. Such panels serve to restrain the cover from expanding too far when the container is being transported in an aircraft.

In some cases however it would be desirable to retain the cover in a condition where it holds the goods down onto a base even during flight in the aircraft. This cannot be achieved merely by the provision of a one-way relief valve permitting air or other gas inside the container to flow out therefrom when the ambient pressure is below that within the container. Such a valve will merely reduce the pressure inside the container to that of the ambient atmosphere; there is no pressure difference and hence the cover no longer serves to hold goods firmly on the base.

In some cases however, a further problem arises. Some goods have to be carried on shock-absorbing mounts, for example resilient mounts, on the base. If the air in the container is evacuated or allowed to escape when the pressure in the aircraft falls substantially below normal atmospheric pressure, then, when the aircraft comes down and the ambient pressure inside the aircraft rises, there is then a very substantial pressure difference between the inside of the container and the surrounding atmosphere. This may cause the cover to be held down so firmly that the shock absorber mounts are compressed to their limits and thereby are no longer effective for protecting the goods against shock loads on the base.

One solution to this problem is disclosed in U.S. Pat. No. 4,117,875 in which suction means are operated continuously and wherein an adjustable bleed orifice open to the atmosphere admits air into a pipe leading from the vacuum suction duct through which air is drawn from the container. The pressure difference between the inside and outside of the container then depends on the pressure drop through the bleed orifice. Such an arrangement however requires the continuous operation of the suction means.

SUMMARY OF THE INVENTION

It is an object of the present invention to provide means for ensuring that the cover of a container of the type described above is always held down by vacuum pressure even when the container is transported by aircraft where the ambient pressure inside the aircraft may fall substantially, without requiring continuous suction but in which excessive vacuum in the container is prevented.

According to the present invention, in a container of the kind having a rigid impermeable base and a flexible impermeable cover sealed to the base, there is provided a vacuum sensor arranged to sense the difference of pressure between the inside of the container and the ambient atmosphere, means for establishing a partial vacuum inside the container, an electrical energising circuit arranged for actuating said vacuum establishing means, said energising circuit being operatively controlled by the pressure sensor to actuate the vacuum establishing means when the pressure difference is below a predetermined value, and a relief valve to prevent the pressure difference exceeding another predetermined value, said sensor comprising a bellows unit arranged to operate at least one mechanically movable contact which controls the electrical energising circuit, the interior of said bellows unit being connected to the interior of the container and said relief valve comprising a resilient diaphragm arranged to close at least one aperture in the movable end of the bellows unit, the diaphragm being constructed to have only a limited travel so that excessive pressure difference causes the bellows to contract and the end of the bellows unit to move away from the diaphragm thereby admitting ambient air into the container through said aperture.

The means for establishing a partial vacuum preferably comprises a pump. For a container carried in an aircraft, however, it would be possible to make use of pressure difference between external atmospheric pressure and the higher ambient pressure maintained within the aircraft; the means for establishing a partial vacuum in this case may therefore comprise an electrically-controlled valve in a connecting pipe line beween the interior of the container and the atmosphere outside the aircraft; in other words, a controlled bleed to the external atmosphere is provided.

The sensor, as stated above, conveniently comprises a bellows unit arranged to operate a mechanically movable contact or contacts which directly or indirectly control the electrical energising circuit. It is convenient to refer more specifically to the use of a pump. In the simplest arrangement, the sensor operates a single contact which opens and closes the pump energising circuit. The pump thus will be switched on and off to keep the bellows just as the point where the contact makes and breaks. Mechanical or electrical delay may be provided to prevent the pump from stopping immediately after it has been started or from starting immediately after it has been stopped so as to reduce the frequency of switching on and off. For example, the bellows may be arranged to operate a sliding contact arranged so that the pump is energised at a first predetermined pressure difference and will remain energised until a second, larger pressure difference is reached. Preferably however there is a pump starting contact arranged to be operated when the pressure difference falls below a predetermined value and the pump energising circuit has a self-holding contact so that the pump remains operating until opening or closing of a further contact by the bellows unit indicates the pressure difference has reached a different higher value.

Provision may be made for mechanically adjusting the positions of one or more contacts for adjusting the vacuum level to be maintained.

It will be seen that such a device will ensure that a partial vacuum is maintained in the container so that the cover of the container is always held down firmly onto the goods on the base of the container even if the ambient atmospheric pressure falls substantially, as for example when the container is carried in an aircraft. Moreover it provides a means for ensuring a required vacuum is maintained when the container is under static condition, for example when being used for storage purposes.

The relief valve preventing excessive pressure difference obviates any possibility of a high pressure difference being reached as, for example, if the vacuum is maintained when the ambient pressure inside the aircraft is below normal atmospheric pressure and the aircraft comes down to a level such that the pressure in the aircraft is increased.

Such excessive pressure difference may be prevented by providing, as said relief valve, a valve on the base or cover of said container arranged to give vacuum relief if the pressure difference exceeds a predetermined amount greater than the vacuum normally maintained by the control of the pump.

With the above-described construction using a bellows and having the interior of the bellows connected to the atmosphere in the container, it is readily possible for the relief valve to provide relief for excessive vacuum pressure to comprise a resilient diaphragm arranged to close an aperture or apertures in the movable end of the bellows unit, the diaphragm being constructed to have only a limited travel so that, if excessive pressure difference causes the bellows to contract substantially, the end of the bellows unit moves away from the diaphragm thereby admitting ambient air into the container.

DESCRIPTION OF THE PREFERRED EMBODIMENT

Figure 1:
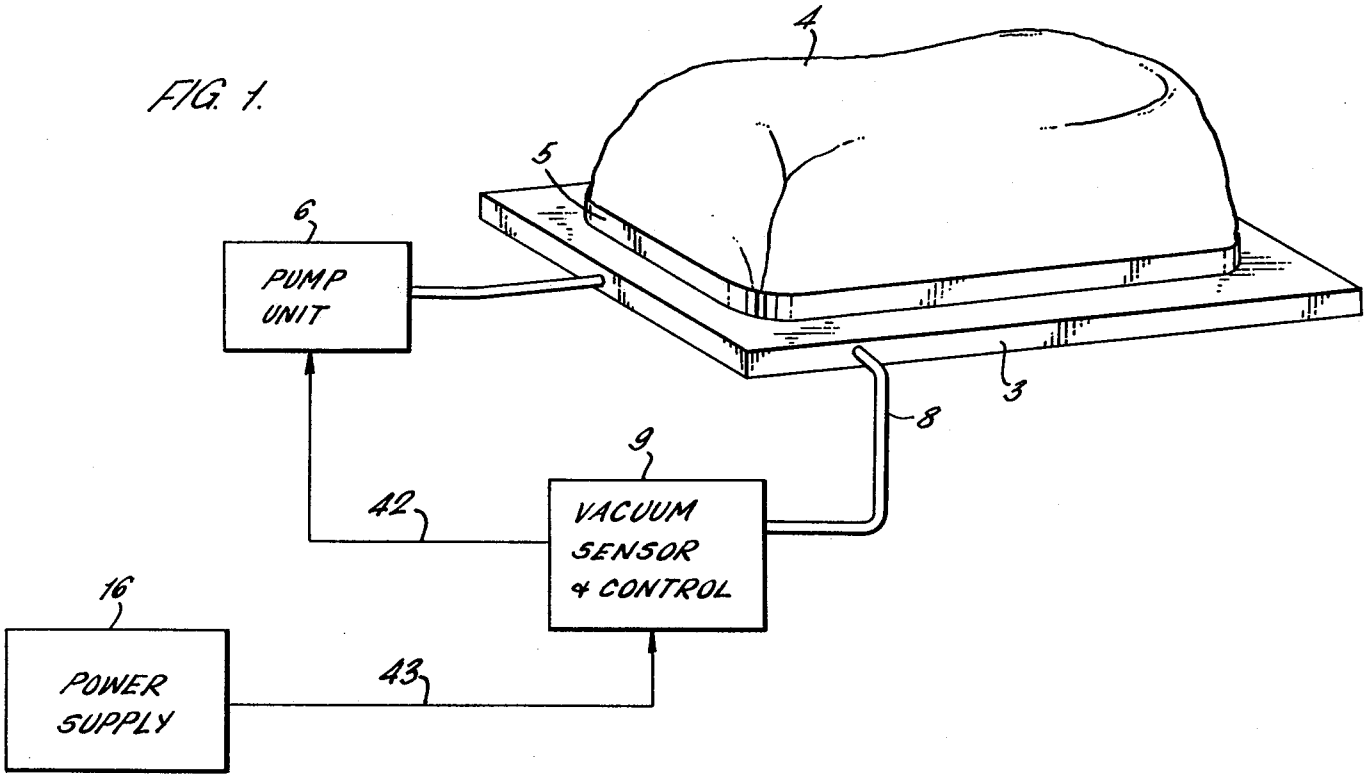
FIG. 1 is a diagram illustrating a container with a vacuum pump together with a sensor and control unit forming one embodiment of the invention.

The container shown in FIG. 1 comprises a rigid impermeable base 3 and an impermeable flexible cover 4 sealed, around the periphery of the cover, in an upstanding channel 5 on the base. An electrically energised pump 6 is provided for partially evacuating air from the interior of the container through a valved aperture in the cover or, more conveniently, in the base as shown at 7. For the purposes of the present invention the container is provided with a further aperture for connection buy a pipe 8 to a vacuum sensor and control unit 9. This unit 9 may be mounted on the container base or may be remote therefrom; conveniently in this case the pipe 8 is a flexible hose. The unit 9 controls the energisation of the pump motor from a power supply source 16 via supply leads 42, 43 as will be more fully described with reference to FIG. 3.

Figure 2:
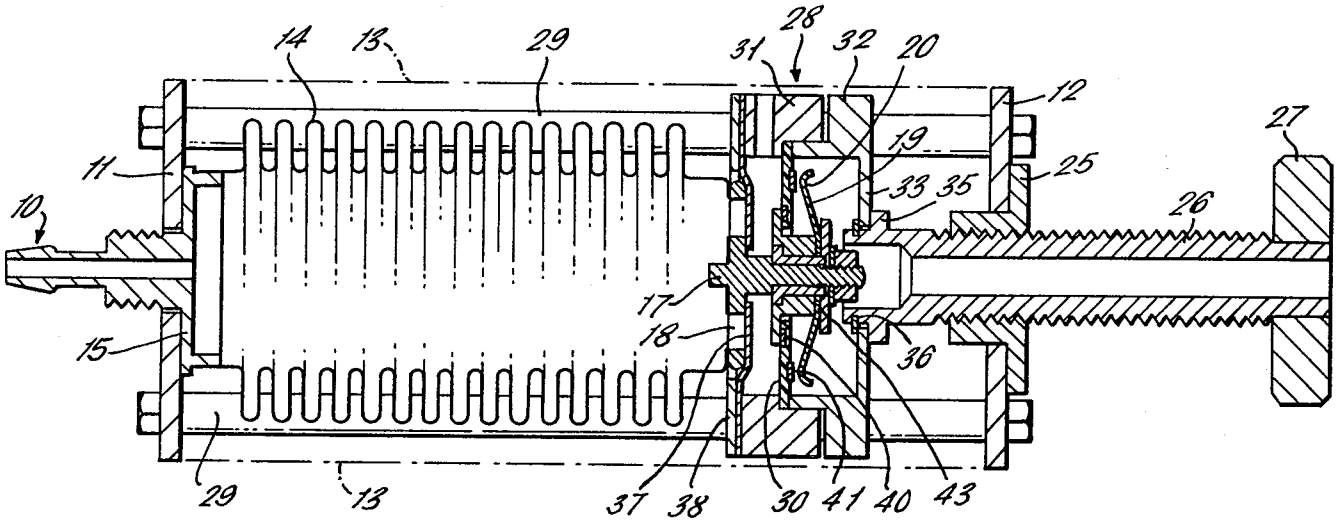
FIG. 2 is a diagrammatic illustration of the sensor and control unit of FIG. 1.

Referring to FIG. 2, the control unit is shown in further detail therein and has a pipe connector 10 for connection, via the aforesaid pipe 8, to the interior of the container. The pipe connector 10 is located at one end of a housing comprising fixed plates 11, 12 of generally square shape and an outer cover indicated diagrammatically at 13 and which is secured on the end plates. Within this housing is a bellows unit 14 having an end closure member 15 integral with the pipe connector 10 so that the interior of the bellows unit is connected to the interior of the container. The end closure unit 15 is secured to the aforementioned housing end plate 11. The other end of the bellows unit is secured to a member 17 having apertures 18, the purpose of which will be described later. This unit 17 is threaded into an insulating bush carrying a metal contact bush 19 and a pair of spring contact members 20.

Secured in the end plate 12 of the housing is a metal bush 25 having an internal thread engaging a threaded tube 26 constituting a lead screw and provided with a manually operable knob 27. This knob 27 permits adjustment of the position of the tube 26 within the bush 25 for setting the required vacuum level, as will be further described later. The tube 26 is secured to a carriage assembly 28. This carriage assembly is movable in the direction of the axis of the bellows and lead screw. For this purpose, the carriage assembly is slidably mounted on guide rods 29 mounted between the end plates 11, 12. Conveniently four such guide rods are provided uniformly spaced around the bellows. The carriage comprises an insulating disc 30 secured between two annular metal members 31, 32. The member 32 has an inwardly-extending flange 33 with a central bore through which the lead screw tube 26 passes. The inner end of this flange 33 is held between a shoulder 35 on the lead screw and a circlip 36 so that the lead screw can rotate without rotation of the carriage 28 but the carriage moves longitudinally with the lead screw. On the member 31 a diaphragm 37 with a central aperture is secured by means of a clamping ring 38. This diaphragm 37 normally extends across the apertures 18 in the end closure 17 of the bellows unit 14 to close and seal those apertures.

On opposite sides of the insulating disc 30 are two annular contact elements 40, 41. The element 40 is positioned so that, when the right-hand end (considering the device as viewed in the drawing) of the bellows unit 14 is deflected towards the right, thereby moving the end closure 17 to the right, a flange 43 on the contact bush 19 bears against the annular contact element 40 so as to complete a circuit (not shown) for starting the vacuum pump to partially exhaust the container. The annular contact element 41 on the other side of the disc 30 cooperates with the aforementioned contact arms 20 on the bush 19 for providing an output signal when the bellows unit 14 is contracted. Conveniently the bellows unit 14 and contact bush 19 are earthed and the aforementioned circuits are responsive to the earth signal produced when the contacts are made. The contact ring 41 provides a signal for an indicator to indicate that there is vacuum in the container and also provides a "stop pump" signal. The start pump signal from annular contact 40 is arranged to complete an operating circuit for the pump motor; the start pump signal initiates operation of the motor which is maintained through a self-holding circuit and the stop pump signal from contact 41 is arranged to interrupt the self-holding circuit.

Figures 3, 4:
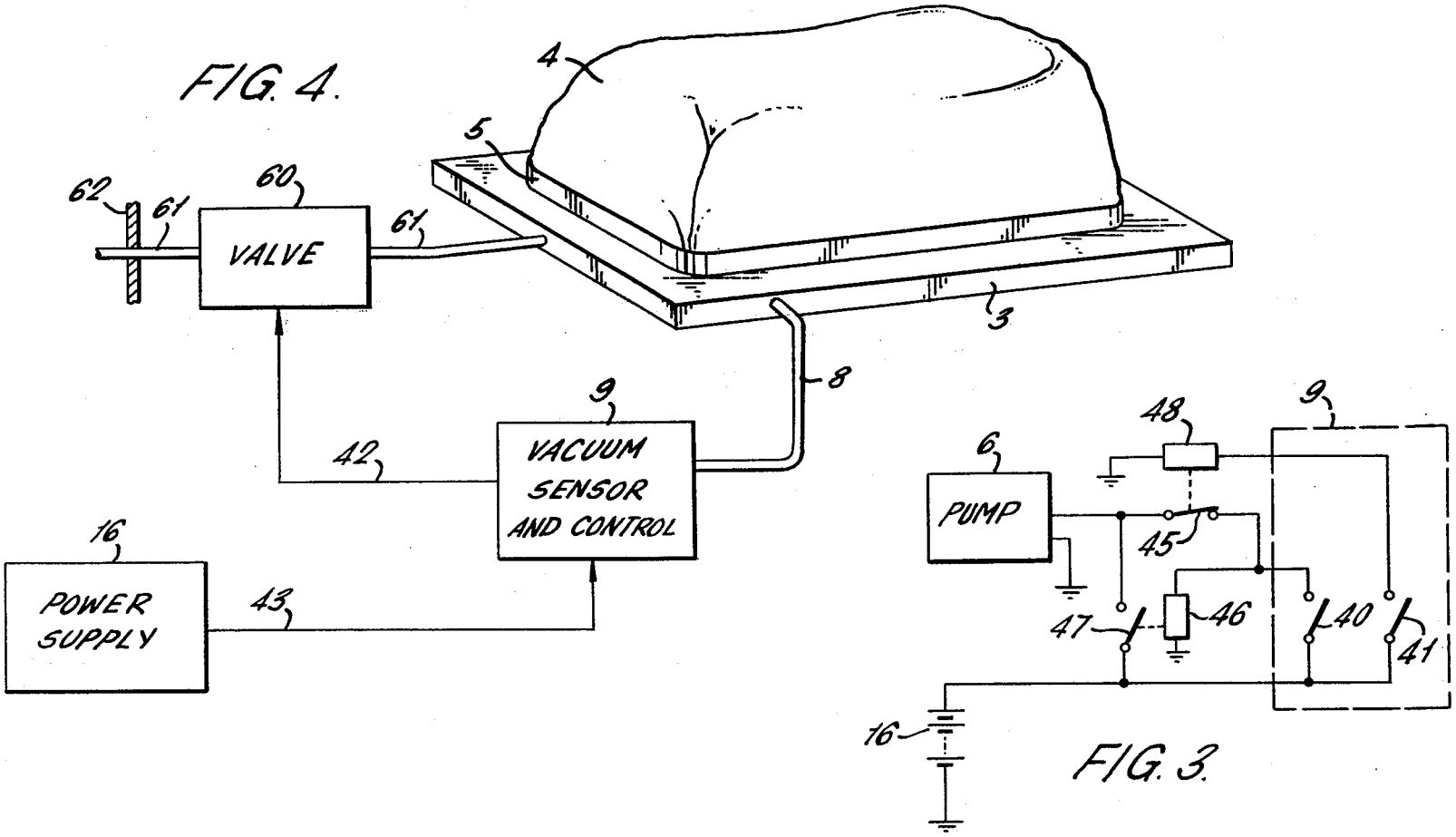
FIG. 3 is a schematic diagram illustrating the electrical circuit of the apparatus of FIG. 1.
FIG. 4 illustrates a modification of the arrangement of FIG. 1.

The electrical circuit arrangement is illustrated diagrammatically in FIG. 3 in which the contact 40 completes a circuit from the power supply 16, shown diagrammatically as a battery, via a normally closed contact 45 to the pump 6. Completion of this circuit energises a relay 46 having a self-holding contact 47 (constituting the above-mentioned self-holding circuit) so that the pump remains in operation until the "stop pump" contact 41 closes to energise a relay 48 opening the aforementioned contact 45. This interrupts the supply to the pump and releases the self-holding circuit.

In operation, the above-described apparatus serves to hold the vacuum in the container at a level such that the closure member moves between limits determined by the two sets of contacts. The actual pressure level corresponding to this position is determined by the position of the carriage 28 which can be adjusted by means of the lead screw 26. The bellows unit 14 would normally be pre-loaded by being compressed slightly, that is to say the carriage would be moved to the left, by means of the lead screw 26 (considering the device as shown in the drawing) so that the bellows initially are slightly compressed via the diaphragm 37 which is thereby held firmly over apertures 18. In this condition, if there is no vacuum in the container, the pump motor is started and pumping of air out of the container will continue until such time as the pressure differential causes the bellows to be compressed sufficiently to move the end member 17 to bring the stop pumping contacts 41, 20 together. In this condition, the container has a reduced pressure which is determined by the initial setting of the carriage position. If there should be any loss of vacuum, the bellows unit 14 will tend to expand so causing the start motor contacts 40, 43 to be brought together. Hence the required vacuum pressure is maintained. It will be seen that the required pressure can be adjusted by the lead screw 26.

If the container is transported by aircraft and is subjected to reduced ambient pressure, the bellows unit 14 expands causing the pump to operate so as to maintain the required pressure differential. As a result of this, the pressure within the container may become substantially lower than atmospheric pressure at ground level and when the aircraft decreases altitude so that the ambient pressure in the aircraft rises, there may be an excessively high vacuum within the container. This causes the bellows unit 14 to contract substantially pulling the right-hand end of the bellows unit and the apertures 18 in the end closure member 17 away from the diaphragm 37 so allowing air to enter through the apertures 18 in the member 17 relieving the excessive vacuum. Such relief will continue until the pressure difference becomes sufficiently small that the end of the bellows seal against the diaphragm 37. This diaphragm 37 therefore provides a safeguard against excessively high vacuum pressure drawing down the container cover onto goods in the container. To provide an adequate air path for admission of air in relieving excessive vacuum, holes 45 are provided through the annular member 31.

In the above-described unit, the setting of the position of the carriage 28 by the lead screw 26 determines the normal pressure difference which will be maintained in the container. Conveniently an indicator, which can be suitably calibrated, is provided for indicating the position of the carriage. For example a pointer can be provided on the carriage with a slot in the housing so that the pointer is visible adjacent a scale marked on the housing.

As previously mentioned, instead of using a pump to establish a partial vacuum, the required vacuum may be obtained making use of the low pressure outside the aircraft. Such an arrangement is illustrated in FIG. 4. In this Figure, the same reference numerals are used as in FIG. 1 to illustrate corresponding components and mention will be made only of the distinctive features of FIG. 4. Instead of the pump 6, there is provided an electrically-controlled valve 60 in a pipe line 61 passing through a wall of the aircraft, shown at 62, to enable the interior of the container to be connected to the low external pressure. The valve 60 is controlled in the same way as the pump 6 of FIG. 1 by the sensor of FIG. 2 using the electrical circuit of FIG. 3.

Figure 5:
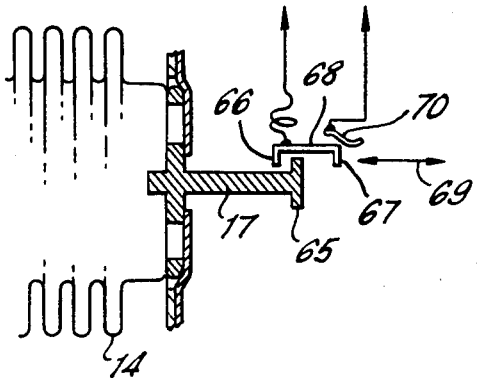
FIG. 5 is a diagram illustrating another form of pump control for the apparatus of FIG. 1.

In the foregoing, a preferred form of control has been described. It will be appreciated however that there are many possible ways of controlling the pump in accordance with the pressure difference sensed by the bellows. In the simplest case, the contacts 40, 43 might be arranged directly to switch the pump on and off so that the pressure difference is maintained at a level such that these contacts are just making and breaking. The frequency with which the pump is switched on and off can be reduced by delays in the mechanical or electrical control. One such arrangement is illustrated diagrammatically in FIG. 5 in which the end closure 17 of bellows unit 14 carries an element 65 located between spaced abutments 66, 67 on a sliding electrical contact 68, which can slide in the direction of movement of the bellows as indicated by arrows 69. When the pressure difference is reduced and the bellows expands, the element 65 eventually engages abutment 67 and moves the sliding contact 68 to complete a circuit through a fixed contact 70 for energising the pump. The pump will remain energised until the contraction of the bellows causes element 65 to engage abutment 66 and so move the sliding contact 68 away from fixed contact 70. The arrangement of FIG. 5, which starts the pump at one predetermined pressure difference and stops it at a second larger pressure difference in effect delays starting of the pump after it has been stopped and delays stopping of it after it has been started.

We claim:

1. A container of the kind having a rigid impermeable base and a flexible impermeable cover sealed to the base wherein there is provided a vacuum sensor arranged to sense the difference of pressure between the inside of the container and the ambient atmosphere, means for establishing a partial vacuum inside the container, an electrical energising circuit arranged for actuating said vacuum establishing means, said energising circuit being operatively controlled by the pressure sensor to actuate the vacuum establishing means when the pressure difference is below a predetermined value, means controlled by said sensor to inhibit the operation of the vacuum establishing means when the pressure difference reaches another predetermined value, and a relief valve operatively controlled by said sensor to prevent the pressure difference exceeding said other predetermined value, said sensor comprising a bellows unit arranged to operate at least one mechanically movable contact which controls the electrical energising circuit, the interior of said bellows unit being connected to the interior of the container and said relief valve comprising a resilient diaphragm arranged to close at least one aperture in the movable end of the bellows unit, the diaphragm being constructed to have only a limited travel so that excessive pressure difference causes the bellows to contract and the end of the bellows unit to move away from the diaphragm thereby admitting ambient air into the container through said aperture.

2. A container as claimed in claim 1 wherein the means for establishfing a partial vacuum comprises a pump.

3. A container as claimed in claim 1 and installed in an aircraft wherein the means for establishing a partial vacuum comprises a connecting pipe line between the interior of the container and the atmosphere outside the aircraft and an electrically controlled valve in said pipe line responsive to the pressure difference sensed by said sensor.

4. A container as claimed in claim 1 and wherein the means for establishing a partial vacuum comprises a pump, said pump being electrically energised and wherein said bellows unit is arranged to operate two movable mechanical contacts for controlling electrical circuits, said movable contacts including a pump starting contact arranged to be operated when the pressure difference falls below a predetermined value and a further contact operated by the bellows unit when the pressure difference has reached a different higher value and wherein the pump energising circuit has a self-holding contact in series with said further contact so that the pump remains operating until operation of said further contact.

5. A container as claimed in claim 4 wherein means are provided for mechanically adjusting the positions of at least one contact of the bellows unit for adjusting the vacuum level to be maintained.

6. A container as claimed in claim 1 wherein said relief valve is a valve arranged to give vacuum relief if the pressure difference exceeds a predetermined amount greater than the vacuum normally maintained by the control of the pump.

* * * * *